United States Patent [19]

Leupold

[11] Patent Number: 4,859,973

[45] Date of Patent: Aug. 22, 1989

[54] SUPERCONDUCTING SHIELDED PYX PPM STACKS

[75] Inventor: Herbert A. Leupold, Eatontown, N.J.

[73] Assignee: The United States of America as represented by the Secretary of the Army, Washington, D.C.

[21] Appl. No.: 327,931

[22] Filed: Mar. 23, 1989

[51] Int. Cl.[4] ..... H01F 7/22

[52] U.S. Cl. ..... 335/216; 335/306; 505/1

[58] Field of Search ..... 335/210, 216, 299, 301, 335/304, 306; 505/1

[56] References Cited

U.S. PATENT DOCUMENTS 4,764,743 8/1988 Leupold et al. ..... 335/306

4,800,353 1/1989 Csonka et al. ..... 335/210

*Primary Examiner*—George Harris

*Attorney, Agent, or Firm*—Michael J. Zelenka; Ann M. Knab

[57] ABSTRACT

Periodic permanent magnet structures comprise a plurality of segments of transversely sliced or truncated hollow cylindrical flux sources each of which produces a uniform high-field in its central cavity. Each flux source has an axial tunnel through its magnetic poles. The sources are arranged linearly with adjacent flux sources in peripheral edge contact with their magnetic fields in alignment so as to form a continuous channel through which a beam of charged particles can travel. Superconducting sheets cover the end faces of each of the sliced flux sources.

7 Claims, 2 Drawing Sheets

SUPERCONDUCTING SHIELDED PYX PPM STACKS

The invention described herein may be manufactured, used, and licensed by or for the Government for governmental purposes without the payment to me of any royalties thereon.

TECHNICAL FIELD

The present invention relates to permanent magnet structures for use in microwave/millimeter wave devices such as traveling wave tubes (TWTs).

BACKGROUND OF THE INVENTION

Both electromagnets and permanent magnets have been used to manipulate beams of charged particles. In traveling wave tubes for example, magnets have been arranged around the channel through which the beam travels to focus the stream of electrons; that is, to reduce the tendency of the electrons to repel each other and spread out. Various configurations of permanent magnets have been attempted in an effort to increase the focusing effect while minimizing the weight and volume of the resulting device. In conventional traveling wave tubes, permanent magnets are typically arranged in a sequence of alternating magnetization, either parallel to, or anti-prallel to, the direction of the electron flow. The magnets are usually annular in shape and their axes are aligned with the path of the electron beam.

Those concerned with the development of magnetic structures have continually searched for a means to maximize the strength of the magnetic field without increasing the mass of the magnetic structure.

SUMMARY OF THE INVENTION

It is therefore an object of the invention to provide a periodic permanent magnet (PPM) structure with compact external dimensions having a magnetic field of increased magnitude.

It is a related object of the invention to provide a periodic permanent magnet structure having a magnetic field of increased amplitude capable of more tightly focusing the path of the electron beam.

It is a further object of the invention to provide a simplified periodic permanent magnet structure with compact external dimensions having a magnetic field of high amplitude.

The present invention makes advantageous use of the "magic ring" which is based upon the hollow cylindrical flux source (HCFS) principle described by K. Halbach in "Proceedings of the Eighth International Workshop on Rare Earth Cobolt Permanent Magnets", Univ. of Dayton, Dayton, Ohio, 1985 (pp. 123–136). A HCFS or "magic ring" is essentially a cylindrical permanent magnet shell that produces an internal magnetic field which is relatively constant in magnitude. The field, which is perpendicular to the axis of the cylinder, possesses a strength which can be greater than the remanence of the magnetic material from which the ring is made.

Ideally, the HCFS is an infinitely long annular cylindrical shell with a circular cross section, that produces an intense transverse magnetic field in its interior working space. No magnetic flux extends to the exterior of the ring structure (except at the ends of a finite cylinder).

In accordance with the present invention, a series of segments of truncated or sliced hollow cylindrical flux sources are placed peripherally tangent to each other in linear fashion. Each flux source has an axial tunnel through its magnetic poles so as to form a continuous channel or path through which a beam of charged particles will travel. The magnetic field orientations within the central cavities are in alignment and may be in the same direction or may alternate direction from flux source to flux source. In any given flux source, the magnetic field orientation in the axial tunnel is always the reverse of the field orientation in the central cavity. Thus, the desirable characteristic of alternating magnetization in a PPM stack is fully realized in a string of truncated hollow cylindrical flux sources.

BRIEF DESCRIPTION OF THE DRAWINGS

The objects, features, and details of the invention will become more readily apparent in light of the detailed description and disclosure in connection with the accompanying drawings wherein.

DETAILED DESCRIPTION

Figure 1:
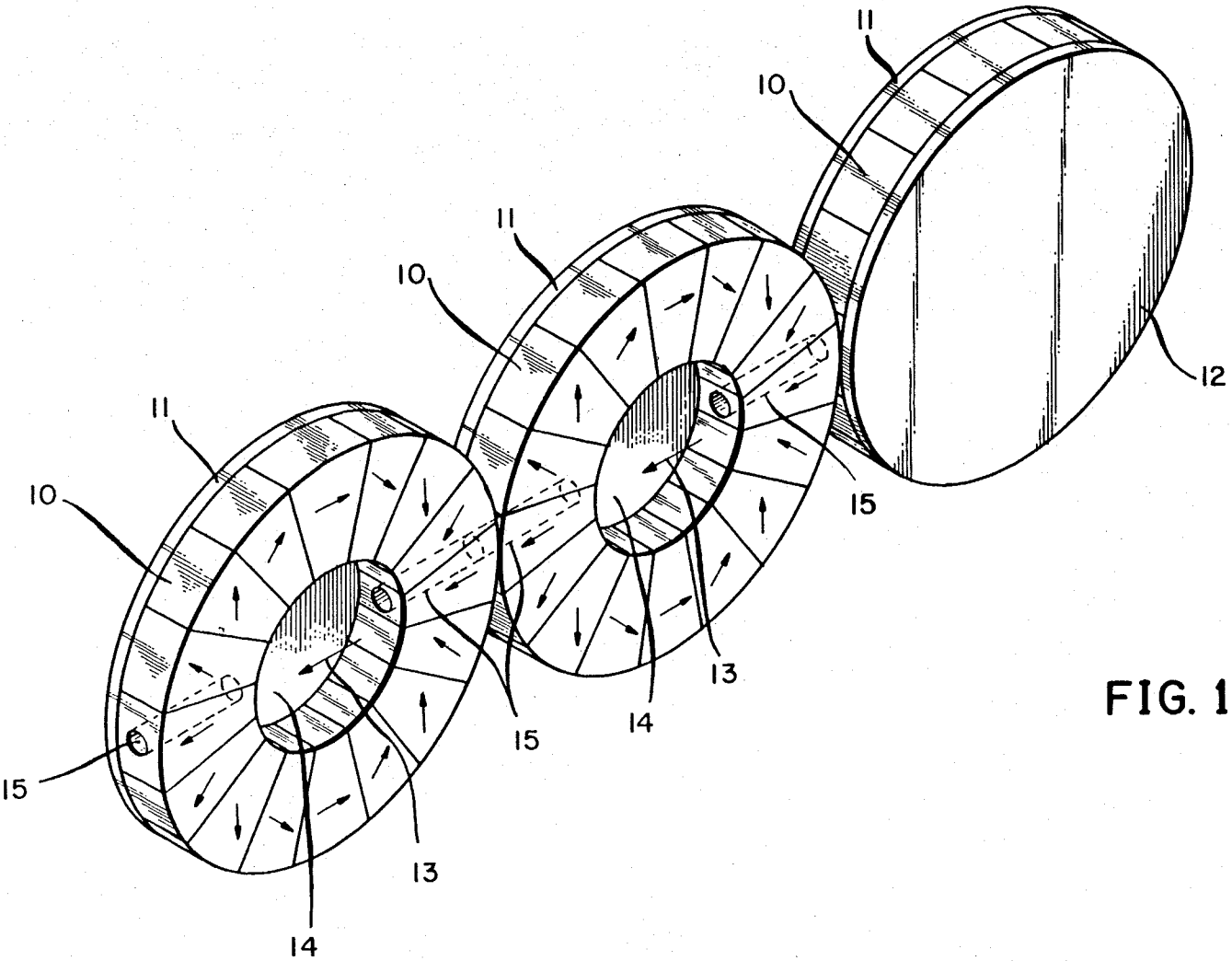
FIG. 1 illustrates an abbreviated series of truncated hollow cylindrical flux sources forming a PPM in accordance with the present invention.

FIG. 1 illustrates a series of complete cylindrical segments of sliced hollow cylindrical flux sources 10 arranged linearly with adjacent truncated hollow cylindrical flux sources 10 in peripheral edge contact and their internal magnetic fields in alignment. Superconducting sheets 11 and 12 cover the faces of the flux sources and are figuratively shown as being peripherally coextensive with the flux sources. These sheets can extend beyond the flux sources, in one or more directions although it is only necessary that they be not less in extent than the flux sources 10. As evident from the figure, the first two flux sources are left uncovered by superconducting sheets (12) in order that a clear picture of the present invention be provided. In actual electronic devices a series of perhaps ten or more flux sources is typically used, but for purposes of illustration a series of three is sufficient.

As noted previously, the ideal HCFS is an annular cylindrical shell that produces a uniform high-field in its central cavity. Unfortunately, the ideal HCFS is not feasible to construct. Therefore, a segmented approximation is resorted to wherein each segment represents a different magnetic orientation. Fortunately, even as few as eight segments provides a field strength that is 90 percent of that of the ideal structure. The resulting magnetic field H may be calculated from the following equation:

$$H = B_r \ln (R_o/R_i)$$

wherein $B_r$ = remanence of HCFS material $R_o$ = outer radius of HCFS $R_i$ = inner radius of HCFS.

Theoretically, a HCFS is infinitely long having uniform field strength. The various applications of the HCFS in the electronics field demand that the length of the HCFS be limited. Therefore, the present invention provides truncated HCFSs.

Superconducting sheets 11, 12 that are placed on the end faces of the flux sources act as diamagnetic mirrors to the field abutting the sheet surface. Thus, the image of the cavity field(s) in the superconducting sheets appears to continue longitudinally in both directions. Infinitely long HCFSs having uniform field strengths are magnetically created through the utilization of the superconducting sheets. Also, with the addition of the superconducting sheets there is no magnetic flux leakage since a magnetic field cannot penetrate a superconducting sheet. The superconducting sheets create an image as if there were a series of infinitely long hollow cylindrical flux sources side by side.

The superconducting sheets shown in the figure are typically quite thin. In practice, the essential requirement is that the sheets be thicker than the penetration depth of the specific superconducting material used. Materials such as tin, lead, niobium, tantalum among others are known to be superconducting below a distinct critical temperature. New ceramic-type materials have been recently developed in the field of superconductivity and are capable of achieving the superconducting state at critical temperatures above 77° K, the boiling point of liquid nitrogen. One such compound $RBa_2Cu_3O_{9-y}$ (where R stands for a transition metal or rare earth ion and y is a number less than 9, preferably $2.1\pm0.05$) has demonstrated superconductive properties above 90° K. Forming techniques include plasma spraying, sputtering, epitaxial film growing, etc. These materials and forming processes are merely exemplary and in no way limit the superconductivity material selected for the sheets, and the manner thereof in which the material is formed.

The large arrows 13 designate the direction of the magnetic field in the central cavities 14. An axial tunnel 15 is drilled through the magnetic poles of each of the flux sources. The flux sources are arranged linearly with adjacent flux sources in peripheral edge contact so that the magnetic fields are in alignment to form a continuous channel or path through which a beam of charged particles may travel.

As apparent from the figure, the magnetic field orientation in the central cavities of the flux sources is the same. As noted previously the magnetic field in the axial tunnel is always the reverse of the orientation in the adjacent central cavity thereby providing a periodic permanent magnetic field. In this embodiment, the width of the wall of each flux source should be approximately one half the width of the central cavity diameter. The magnetic field profile can be substantially represented by a square wave pattern.

An alternate embodiment encompasses reversing or alternating the magnetic field orientation in successive rings of a series. In this case, the width of the wall should be approximately the same as the diameter of the cavity. A more complex square wave pattern is representative of the magnetic field profile, but the average magnetic field is greater than the average magnetic field obtained from the previously discussed design with comparative widths.

Experiments were conducted in which the diameter of the axial tunnel 15 of the HCFS series was varied from 2 mm to 10 mm and substantially the same (magnetic field) curve was obtained in each case. A PPM stack in accordance with the invention is very forgiving with regard to tunnels that are drilled axially through the magnetic poles and which can be up to one-fourth the diameter of the central cavity(ies).

Depending on the intended use of the structure, the dimensions of both aforementioned designs may be varied in order to achieve the desired magnetic field profile.

The magnetic field produced in these structures is of greater amplitude than that of conventional prior art PPM structures. Consequently, more efficient results can be expected in TWT performance, such as a more tightly focused beam and a greater power output.

Figure 2:
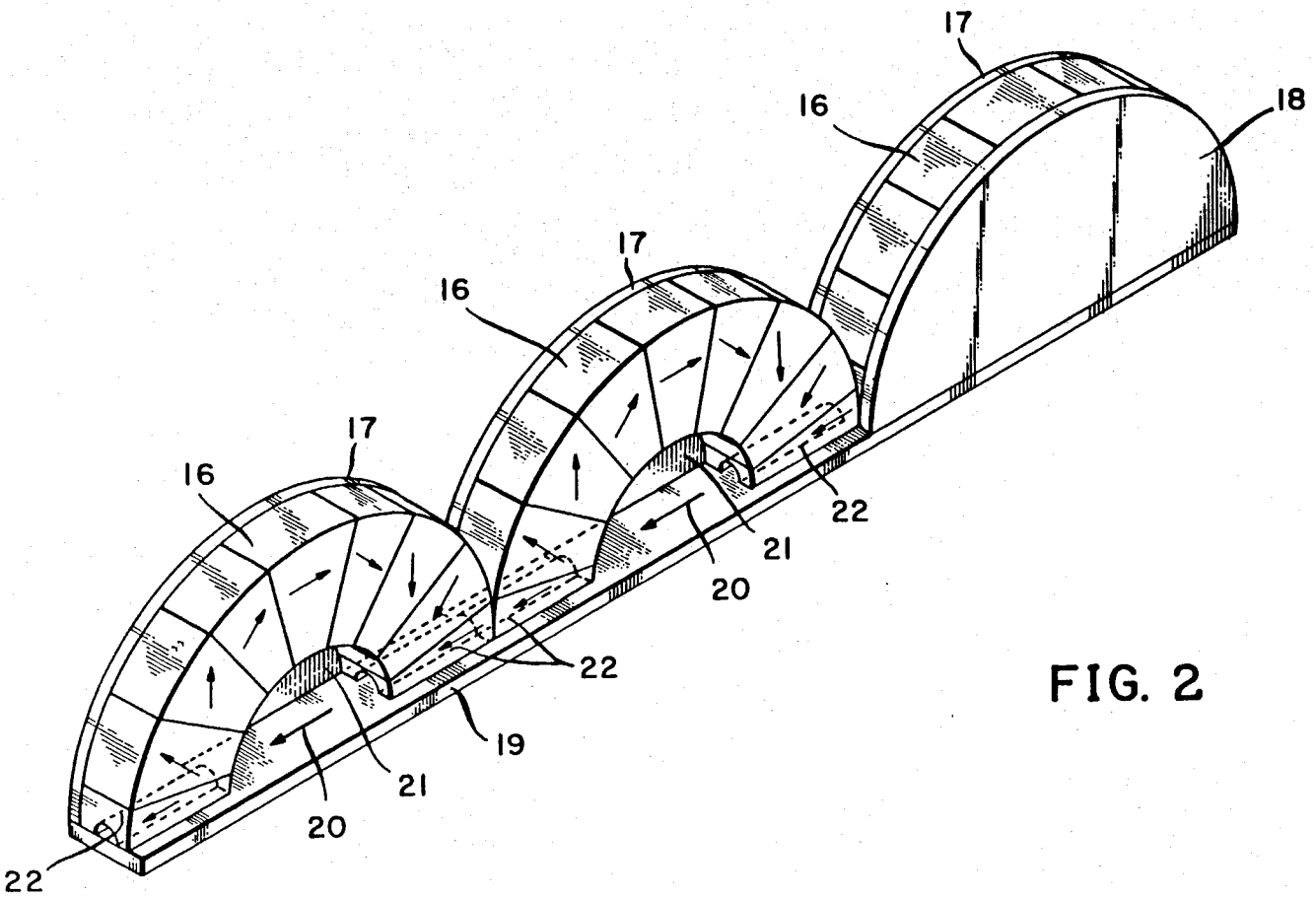
FIG. 2 illustrates an abbreviated series of truncated hollow semi-annular flux sources forming a PPM in accordance with the present invention.

FIG. 2 illustrates a half-structure of the HCFS series of FIG. 1. A plurality of semicylindrical segments of sliced hollow cylindrical flux sources 16 are arranged linearly with adjacent sources 16 in peripheral edge contact, their magnetic fields being in alignment. Superconducting plates 17 and 18 cover the faces of the flux sources and are figuratively shown as being peripherally coextensive with the flux sources. Similarly, as with the FIG. 1 embodiment, the plates may extend beyond the flux sources although it is only necessary that they be not less in extent than the flux sources 16. A superconducting planar plate 19 bounds the flat bottom half of each segment of the series of flux sources 16 magnetically providing an image of the half structure thereby effectively replacing the missing half. The magnetic field supplied by a full structure may thus be obtained, but with half the structure, through the utilization of the superconducting plane 19.

The large arrow 20 designates the magnetic field direction in each semicircular central cavity 21. An axial tunnel 22 is drilled through the magnetic poles of each of the flux sources to provide a channel through which an electron beam may travel. As with the superconducting face plates, the superconducting plate 19 provides a (magnetic) mirror image thereby completing the rest of the flux source.

As with the full structure, the magnetic field orientation in the half structure may be the same in successive central cavities, or it may alternate from source to source.

In this way, uniform periodic magnetic fields may be obtained from simplified compact structures.

Having shown and described what is at present to be the preferred embodiments of the invention, it should be understood that the same has been shown by way of illustration and not limitation. And, all modifications, alterations and changes coming within the spirit and scope of the invention are meant to be included herein.

What is claimed is:

1. A periodic permanent magnet structure comprising a plurality of segments of sliced hollow cylindrical flux sources each of which produces a uniform high-field in its central cavity, each flux source having an axial tunnel through the magnetic poles of the flux source, the flux sources arranged linearly with adjacent flux sources in peripheral edge contact so that the magnetic fields are in alignment, a continuous channel being formed through the plurality of axially aligned flux sources, and further comprising a pair of superconducting sheets covering the end faces of each of the sliced flux sources.

2. A periodic permanent magnet structure as defined in claim 1 comprising complete cylindrical segments of sliced hollow cylindrical flux sources.

3. A periodic permanent magnet structure as defined in claim 2 wherein the magnetic field orientations in the central cavities of the flux sources are the same.

4. A periodic permanent magnet structure as defined in claim 2 wherein the magnetic field orientation in the central cavities of the flux sources alternates in direction from source to source.

5. A periodic permanent magnet structure as defined in claim 1 comprising semicylindrical segments of sliced hollow cylindrical flux sources, each segment having a flat bottom half, and further comprising a superconducting plane bounding the flat bottom halves of the flux sources.

6. A periodic permanent magnet structure as defined in claim 5 wherein the magnetic field orientations in the central cavity of the flux sources are the same.

7. A periodic permanent magnet structure as defined in claim 5 wherein the magnetic field orientation in the central cavities of the flux sources alternates in direction from source to source.

* * * * *